US008127834B2

(12) United States Patent
Wright et al.

(10) Patent No.: US 8,127,834 B2
(45) Date of Patent: Mar. 6, 2012

(54) MODULAR ELECTRO-HYDRAULIC CONTROLLER FOR WELL TOOL

(75) Inventors: Adam D. Wright, McKinney, TX (US); Adam H. Martin, Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 114 days.

(21) Appl. No.: 12/352,892

(22) Filed: Jan. 13, 2009

(65) Prior Publication Data

US 2010/0175868 A1 Jul. 15, 2010

(51) Int. Cl.
*E21B 34/10* (2006.01)

(52) U.S. Cl. ..... 166/66.4; 166/72

(58) Field of Classification Search ..... 166/65.1, 166/66.4, 72

See application file for complete search history.

(56) References Cited

U.S. PATENT DOCUMENTS 3,092,135 A 6/1963 Brown et al.

(Continued)

FOREIGN PATENT DOCUMENTS

EP 0500341 B1 8/1992

(Continued)

OTHER PUBLICATIONS

Schlumberger IRIS Safety Valve Product Brochure, 2007, 1 page.

(Continued)

*Primary Examiner* — William P Neuder
(74) *Attorney, Agent, or Firm* — Smith IP Services, P.C.

(57) ABSTRACT

An actuator control system includes a housing assembly having at least one line therein for controlling operation of an actuator, and a modular controller attached externally to the housing assembly and interconnected to the line. A method of constructing an actuator control system includes the steps of: assembling a modular controller, the modular controller including a control valve therein for controlling operation of an actuator via a hydraulic line; testing the modular controller, including functionally testing the control valve; and then attaching the modular controller to a housing assembly having the line formed therein. Another actuator control system includes a housing assembly having at least one line therein for controlling operation of an actuator, and a modular controller attached separately to the housing assembly and interconnected to the line via a manifold of the modular controller, the manifold including a concave interface surface which receives the housing assembly therein.

23 Claims, 9 Drawing Sheets

U.S. PATENT DOCUMENTS

| | | | | |
|---|---|---|---|---|
| 3,494,419 | A | 2/1970 | Mullins | |
| 3,533,430 | A | 10/1970 | Fredd | |
| 3,834,460 | A | 9/1974 | Brun et al. | |
| 4,025,883 | A * | 5/1977 | Slade et al. | 335/16 |
| 4,230,187 | A | 10/1980 | Seto et al. | |
| 4,398,519 | A | 8/1983 | Tissot et al. | |
| 4,421,174 | A | 12/1983 | McStravick et al. | |
| 4,566,478 | A | 1/1986 | Deaton | |
| 4,633,952 | A | 1/1987 | Ringgenberg | |
| 4,658,904 | A | 4/1987 | Doremus et al. | |
| 4,848,472 | A | 7/1989 | Hopper | |
| 4,922,423 | A | 5/1990 | Koomey et al. | |
| 4,986,357 | A | 1/1991 | Pringle | |
| 5,050,681 | A | 9/1991 | Skinner | |
| 5,101,907 | A | 4/1992 | Schultz et al. | |
| 5,117,685 | A | 6/1992 | Goldschild | |
| 5,127,477 | A | 7/1992 | Schultz | |
| 5,192,167 | A | 3/1993 | Da Silva et al. | |
| 5,234,057 | A | 8/1993 | Schultz et al. | |
| 5,238,070 | A | 8/1993 | Schultz et al. | |
| 5,251,703 | A | 10/1993 | Skinner | |
| 5,271,313 | A * | 12/1993 | Lindegren, III | 91/358 R |
| 5,273,113 | A | 12/1993 | Schultz | |
| 5,412,568 | A | 5/1995 | Schultz | |
| 5,831,156 | A | 11/1998 | Mullins | |
| 5,890,542 | A | 4/1999 | Ringgenberg | |
| 6,085,845 | A | 7/2000 | Patel et al. | |
| 6,419,022 | B1 | 7/2002 | Jernigan et al. | |
| 6,422,315 | B1 * | 7/2002 | Dean | 166/339 |
| 6,450,258 | B2 | 9/2002 | Green et al. | |
| 6,536,530 | B2 | 3/2003 | Schultz et al. | |
| 6,622,799 | B2 * | 9/2003 | Dean | 166/381 |
| 6,799,633 | B2 | 10/2004 | McGregor | |
| 6,917,857 | B2 | 7/2005 | Rentmeester et al. | |
| 7,082,994 | B2 | 8/2006 | Frost, Jr. et al. | |
| 7,111,675 | B2 | 9/2006 | Zisk, Jr. | |
| 7,140,436 | B2 | 11/2006 | Grant et al. | |
| 7,201,230 | B2 | 4/2007 | Schultz et al. | |
| 7,240,734 | B2 | 7/2007 | Nivens et al. | |
| 2004/0226720 | A1 | 11/2004 | Schultz et al. | |
| 2007/0029078 | A1 | 2/2007 | Wright | |
| 2009/0133879 | A1 | 5/2009 | Wright et al. | |

FOREIGN PATENT DOCUMENTS

| | | | |
|---|---|---|---|
| EP | 0500343 | B1 | 8/1992 |
| EP | 0604156 | B1 | 6/1994 |
| WO | 03021075 | A1 | 3/2003 |

OTHER PUBLICATIONS

Schlumberger IRIS Dual Valve Product Brochure, 2007, 2 pages.
Schlumberger IRIS Pulse-operated fullbore tools Product Brochure, Oct. 2001, 8 pages.
Halliburton DynaLink™ Telemetry System Product Brochure, Jan. 2009, 2 pages.
Examination Report for GB0609150.8 issued Jun. 5, 2007, 1 page.
Examination Report for GB 0410709.0 issued Aug. 31, 2006, 1 page.
Search Report for GB 0410709.0 issued Aug. 18, 2004, 1 page.
Office Action issued Jul. 8, 2005, for U.S. Appl. No. 10/438,793, 14 pages.
Office Action issued Jun. 22, 2006, for U.S. Appl. No. 10/438,793, 6 pages.
Scott Rotary Seals Custom Products webpage, Nov. 14, 2007, 2 pages.
Scott Rotary Seals Product Family Introduction webpage, Nov. 27, 2007, 1 page.
Office Action issued Mar. 2, 2011, for U.S. Appl. No. 12/410,785, 16 pages.
Office Action issued Mar. 7, 2011, for U.S. Appl. No. 12/352,901, 21 pages.
Office Action issued Jun. 30, 2011 for U.S. Appl. No. 13/021,624, 20 pages.
Office Action issued Aug. 15, 2011 for U.S. Appl. No. 12/410,785, 15 pages.
Office Action issued Jul. 28, 2011 for U.S. Appl. No. 12/352,901, 13 pages.

* cited by examiner

MODULAR ELECTRO-HYDRAULIC CONTROLLER FOR WELL TOOL

BACKGROUND

The present disclosure relates generally to equipment utilized and operations performed in conjunction with a subterranean well and, in an embodiment described herein, more particularly provides a modular electro-hydraulic controller for a well tool.

Typically, electro-hydraulic controls for operation of downhole well tools have been packaged in an annular area between a tubular inner mandrel and a tubular outer housing. Unfortunately, this type of arrangement generally requires that the electro-hydraulic controls, inner mandrel, outer housing, etc., be completely assembled for testing and disassembled for resolution of any problems uncovered in the testing. This can be time-consuming and difficult to accomplish, particularly at a wellsite.

In addition, the most failure-prone components (the wires, electronics, connectors, etc.) of the assembly are housed within large, heavy and bulky housings, with the result that these components are frequently damaged during assembly. One reason that the housings are so heavy and bulky is that they must resist large pressure differentials downhole.

However, the pressure differential resisting capability of a housing could be enhanced, without increasing the size of the housing, if it were not necessary to contain the electro-hydraulic components of the control system in a large annular area within the housing. An otherwise solid housing could be used instead, with recesses machined into a sidewall of the housing for receiving the components, but this is very expensive and generally requires the use of cross-drilled holes to connect wires, hydraulics, etc.

Therefore, it may be seen that advancements are needed in the art of controlling actuation of well tools downhole.

SUMMARY

In the present specification, a modular controller and associated methods are provided which solve at least one problem in the art. One example is described below in which the controller is separate from a housing assembly which interconnects to one or more actuators. Another example is described below in which the controller incorporates components therein which can be conveniently tested and replaced, apart from any other components of an actuator control system.

In one aspect, an actuator control system is provided by the present disclosure. The actuator control system includes a generally tubular housing assembly having at least one line (such as one or more hydraulic lines) therein for controlling operation of an actuator, and a modular controller attached externally to the housing assembly and interconnected to the line.

In another aspect, a method of constructing an actuator control system is provided which includes the steps of: assembling a modular controller, the modular controller including a control valve therein for controlling operation of an actuator via one or more hydraulic lines; testing the modular controller, including functionally testing the control valve; and then attaching the modular controller to a housing assembly having the hydraulic line formed therein. This allows control of the actuator via the control valve of the controller.

In yet another aspect, an actuator control system is provided which includes a generally tubular housing assembly having at least one line therein for controlling operation of an actuator, and a modular controller attached separately to the housing assembly and interconnected to the line via a manifold of the modular controller. The manifold includes a concave interface surface which receives the housing assembly therein.

The housing assembly may be provided with an uninterrupted interior profile for retrievable bi-directional running tools.

These and other features, advantages and benefits will become apparent to one of ordinary skill in the art upon careful consideration of the detailed description of representative embodiments below and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
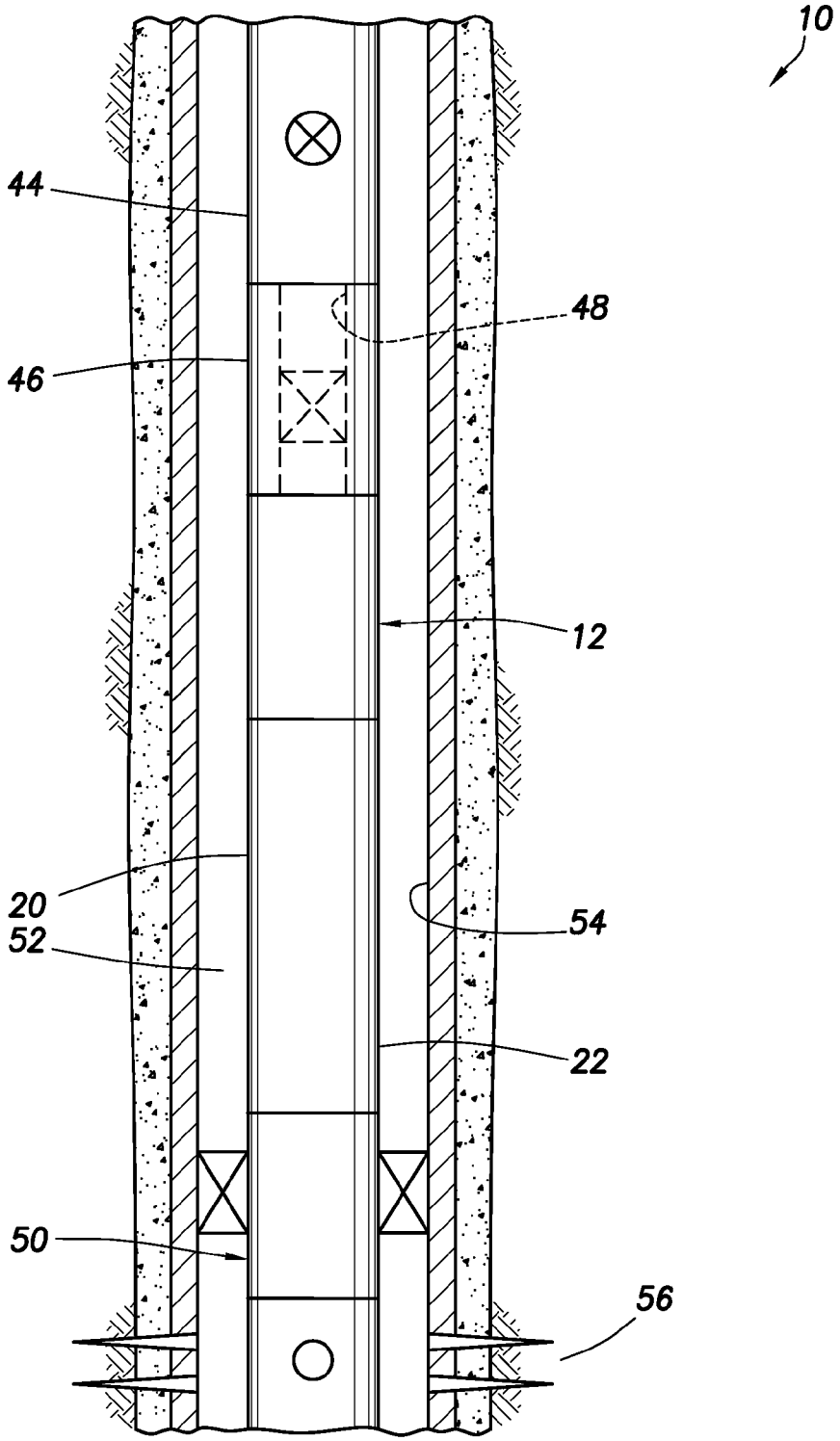
FIG. 1 is a schematic partially cross-sectional view of a well system embodying principles of the present disclosure.

Representatively illustrated in FIG. 1 is a well system 10 which embodies principles of the present disclosure. In the well system 10, a drill stem test is performed utilizing, in part, well tools 44, 46 for controlling flow between an interior flow passage 48 of a tubular string 50, an annulus 52 formed between the tubular string and a wellbore 54, and a formation 56 intersected by the wellbore. The wellbore 54 could be cased, as depicted in FIG. 1, or it could be uncased.

Figure 2:
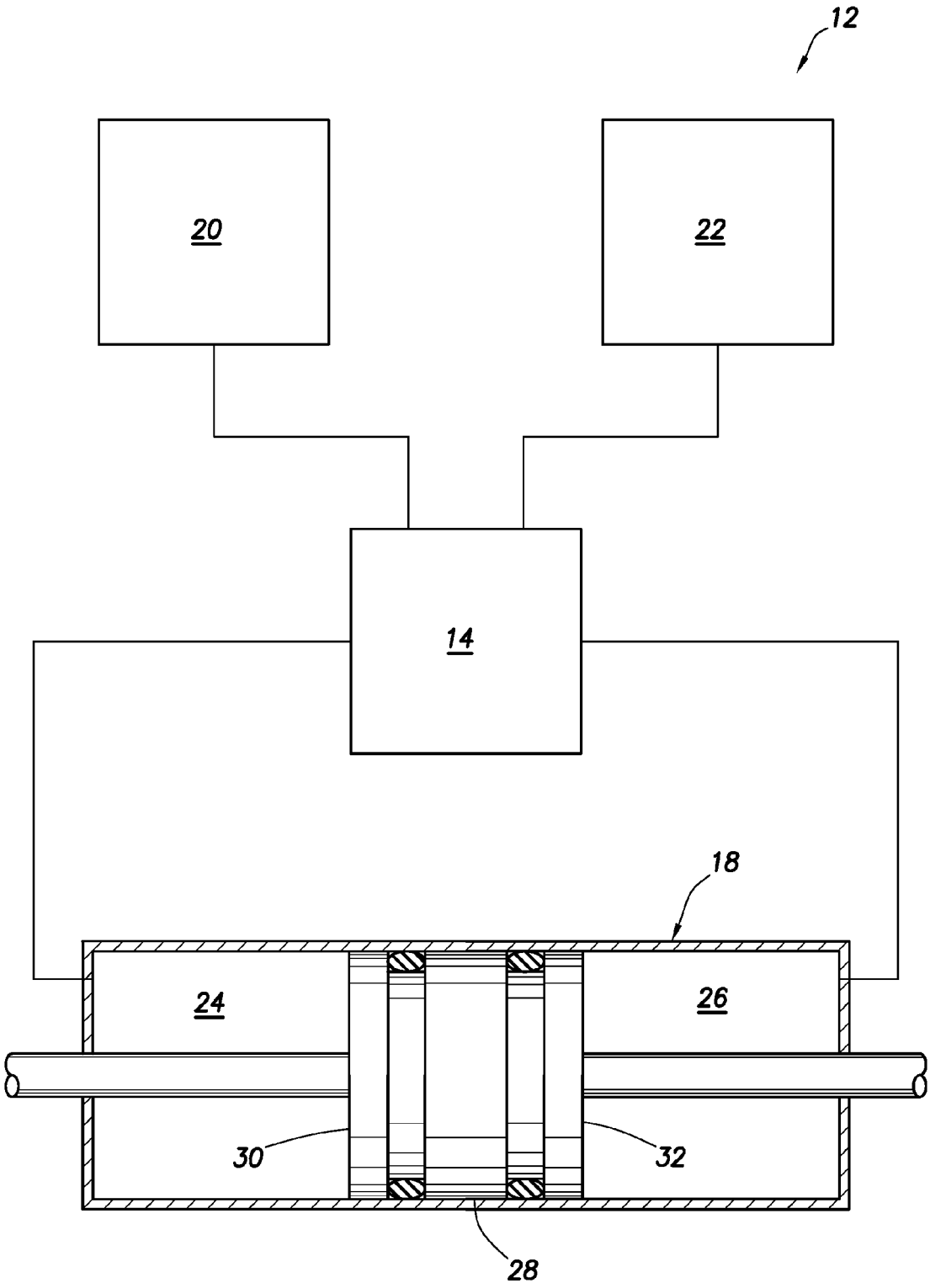
FIG. 2 is an enlarged scale schematic partially cross-sectional view of an actuator control system which may be used in the well system of FIG. 1, the control system embodying principles of the present disclosure.

An actuator control system 12 is interconnected in the tubular string 50. The control system 12 is used to control operation of actuators of the well tools 44, 46 during the drill stem test. The actuators of the well tools 44, 46 may be of conventional design and so are not described further herein, but a schematic actuator 18 which may be used in the well tools 44, 46 is depicted in FIG. 2.

Alternatively, an actuator for operating both of the well tools 44, 46 could be as described in the U.S. patent application filed concurrently herewith, entitled MULTI-POSITION HYDRAULIC ACTUATOR, the entire disclosure of which is incorporated herein by this reference.

The control system 12 controls operation of the actuators by selectively applying pressure to pistons of the actuators. For this purpose, the tubular string 50 may also include pressure sources 20, 22.

For example, a relatively low pressure source could be an atmospheric chamber or a low pressure side of a pump. A relatively high pressure source could be a pressurized gas chamber, hydrostatic pressure in the well, or a high pressure side of a pump. Any type of pressure source could be used, and it is not necessary for any of the pressure sources to be interconnected in the tubular string 50, in keeping with the principles of the invention. For example, if hydrostatic pressure is used as a pressure source, the annulus 52 or passage 48 could serve as the pressure source.

The well tool 44 is depicted in FIG. 1 as being a circulating valve, and the well tool 46 is depicted as being a tester valve. However, actuation of any other type or combination of well tools could be controlled using the control system 12.

At this point, it should be reiterated that the well system 10 is merely one example of an application of the principles of this disclosure. It is not necessary for a drill stem test to be performed, for the control system 12 to be interconnected in the tubular string 50, for fluid communication between the formation 56, passage 48 and annulus 52 to be controlled, or for well tools 44, 46 to be actuated. The principles of this disclosure are not limited in any manner to the details of the well system 10.

Referring additionally now to FIG. 2, a schematic hydraulic circuit diagram of the control system 12 is representatively illustrated apart from the well system 10. In this view, it may be seen that a control valve 14 of the control system 12 is interconnected between the pressure sources 20, 22 and chambers 24, 26 on opposite sides of a piston 28 in the actuator 18.

The control valve 14 could comprise a single valve with multiple inputs and outputs, or it could comprise multiple individual valves. The control valve 14 may be operated in any manner (e.g., electrically, hydraulically, magnetically, etc.). A specific example of a motor-driven rotary control valve is described below, but it should be understood that any type of control valve or valves (such as, a linear actuator-operated spool valve, pressure-operated pilot valves, an array of solenoid-operated valves, etc.) may be used in keeping with the principles of this disclosure.

An example of an acceptable control valve is described in U.S. patent application Ser. No. 11/199,093, filed Aug. 8, 2005 and published as US2007-0029078. The entire disclosure of this prior application is incorporated herein by this reference.

As depicted in FIG. 2, the chambers 24, 26 are in fluid communication with respective opposing surface areas 30, 32 on the piston 28. However, in other embodiments, it would not be necessary for the chambers 24, 26 and surface areas 30, 32 to be on opposite sides of the piston 28.

It is also not necessary for the piston 28 to have a cylindrical shape as depicted in FIG. 2. The piston 28 could instead have an annular shape or any other shape. If the actuator described in the incorporated concurrently filed application referenced above is used in the control system 12, the actuator 18 would include multiple annular pistons for operating both of the well tools 44, 46.

In the example of FIG. 2, the pressure source 20 will be described as a high pressure source, and pressure source 22 will be described as a low pressure source. In other words, the pressure source 20 supplies an increased pressure relative to the pressure supplied by the pressure source 22.

For example, the pressure source 20 could supply hydrostatic pressure and the pressure source 22 could supply substantially atmospheric pressure. The preferable condition is that a pressure differential between the pressure sources 20, 22 is maintained, at least during operation of the actuator 18.

When it is desired to displace the piston 28 to the right as viewed in FIG. 2, the control valve 14 is operated to permit fluid communication between the pressure source 20 and the chamber 24, and to permit fluid communication between the pressure source 22 and the chamber 26. When it is desired to displace the piston 28 to the left as viewed in FIG. 2, the control valve 14 is operated to permit fluid communication between the pressure source 22 and the chamber 24, and to permit fluid communication between the pressure source 20 and the chamber 26.

Such displacement of the piston 28 can be reversed and repeated as desired. However, the number of times the piston 28 can be displaced may be limited by some resource (e.g., electrical power, hydraulic fluid, pressure differential, etc.) available to the control system 12.

Although only one actuator 18, one piston 28 and two pressure sources 20, 22 are depicted in the control system 12 of FIG. 2, it will be appreciated that any number or combination of these elements may be provided in a control system incorporating principles of this disclosure.

Figure 3:
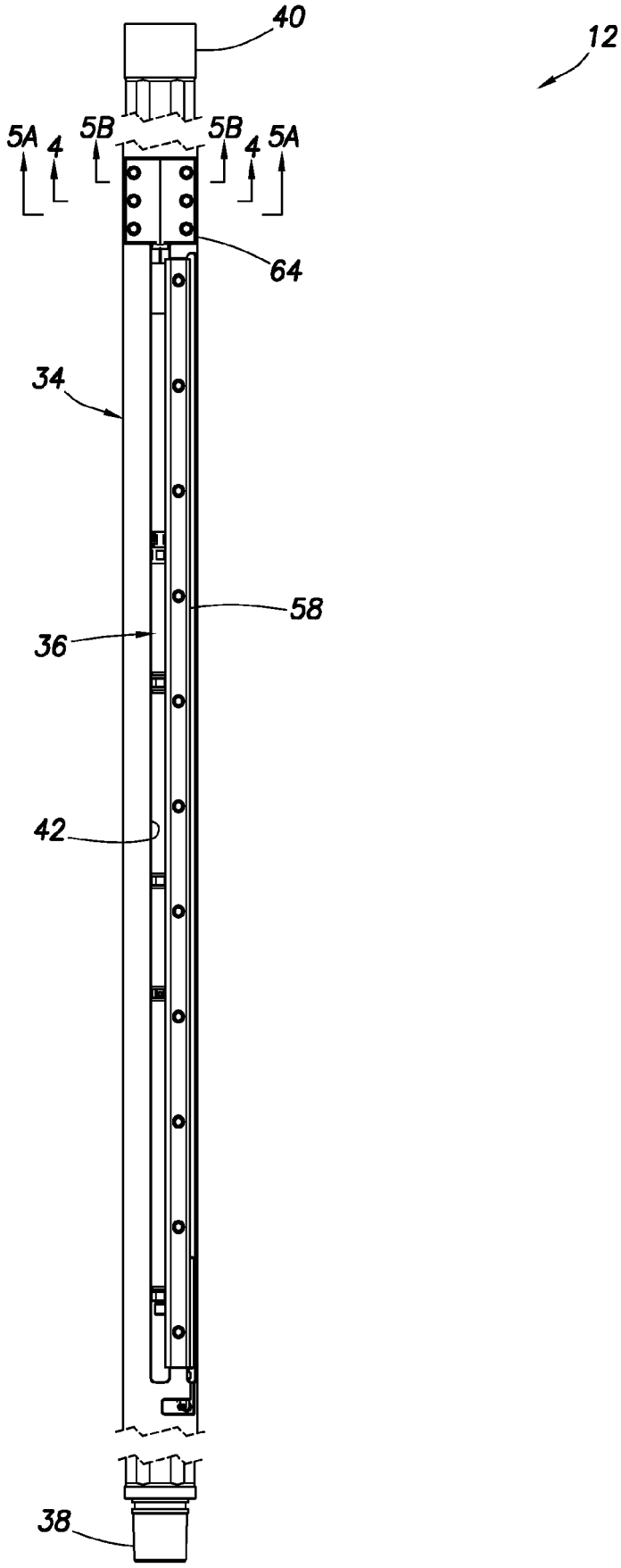
FIG. 3 is a side elevational view of a housing assembly and modular controller of the control system.

Referring additionally now to FIG. 3, a side elevational view of a housing assembly 34 and modular controller 36 of the control system 12 is representatively illustrated. The housing assembly 34 is preferably interconnected in the tubular string 50 in the well system 10 by means of externally and internally threaded connectors 38, 40 so that the flow passage 48 extends longitudinally through the housing assembly. However, it should be clearly understood that the control system 12, housing assembly 34 and modular controller 36 can be used in well systems other than the well system 10 of FIG. 1, in keeping with the principles of this disclosure.

In one unique feature of the control system 12, the modular controller 36 is received in a longitudinally extending recess 42 formed externally on the housing assembly 34. The controller 36 is retained in the recess 42 by an elongated retainer 58 which presses the controller against sides of the recess for enhanced acoustic coupling when acoustic telemetry is used for communicating between the controller and a remote location. The manner in which the retainer 58 secures the controller 36 in the recess 42 can be more clearly seen in FIG. 7.

In another unique feature of the control system 12, the controller 36 is separately attached to the housing assembly 34 and is connected to control lines 60, 82 therein (see FIG. 7) by a manifold 64. The manifold 64 provides sealed fluid communication between the lines 60, 62, 80, 82 in the housing assembly 34 and the control valve 14 in the controller 36.

In yet another unique feature of the control system 12, the controller 36 (including each of the components thereof described more fully below) can be functionally and pressure tested separately from the housing assembly 34, so that any problems uncovered in the controller testing can be conveniently remedied without use or handling of the housing assembly. For example, operation of the control valve 14 can be confirmed prior to connecting the controller 36 to the housing assembly 34.

Likewise, the housing assembly 34 can be tested, maintained, repaired, etc. apart from the controller 36. Furthermore, the assembled downhole tool assembly can be function tested, operating well tools 44, 46, apart from the controller 36.

If, for example, a problem is uncovered in the controller 36, this configuration of the control system 12 permits relatively rapid detection and resolution of the problem. In addition, the external attachment of the controller 36 on the housing assembly 34 means that the controller can be easily and conveniently replaced, if necessary, without substantial downtime or interruption of wellsite activities.

This is a significant advantage over conventional control systems in which an annular space between an inner mandrel and an outer housing of a housing assembly is used to contain components of the control system, some of which extend completely around the annular space and encircle a flow passage extending through the housing assembly. In such conventional control systems, the components in the annular space must be tested while positioned in the housing assembly, and the housing assembly cannot be pressure tested apart from the components therein. Thus, a problem with one component, or with a seal in the housing assembly, typically requires the entire control system to be disassembled, the problem resolved, the control system reassembled, the control system re-tested, etc.

Figure 4:
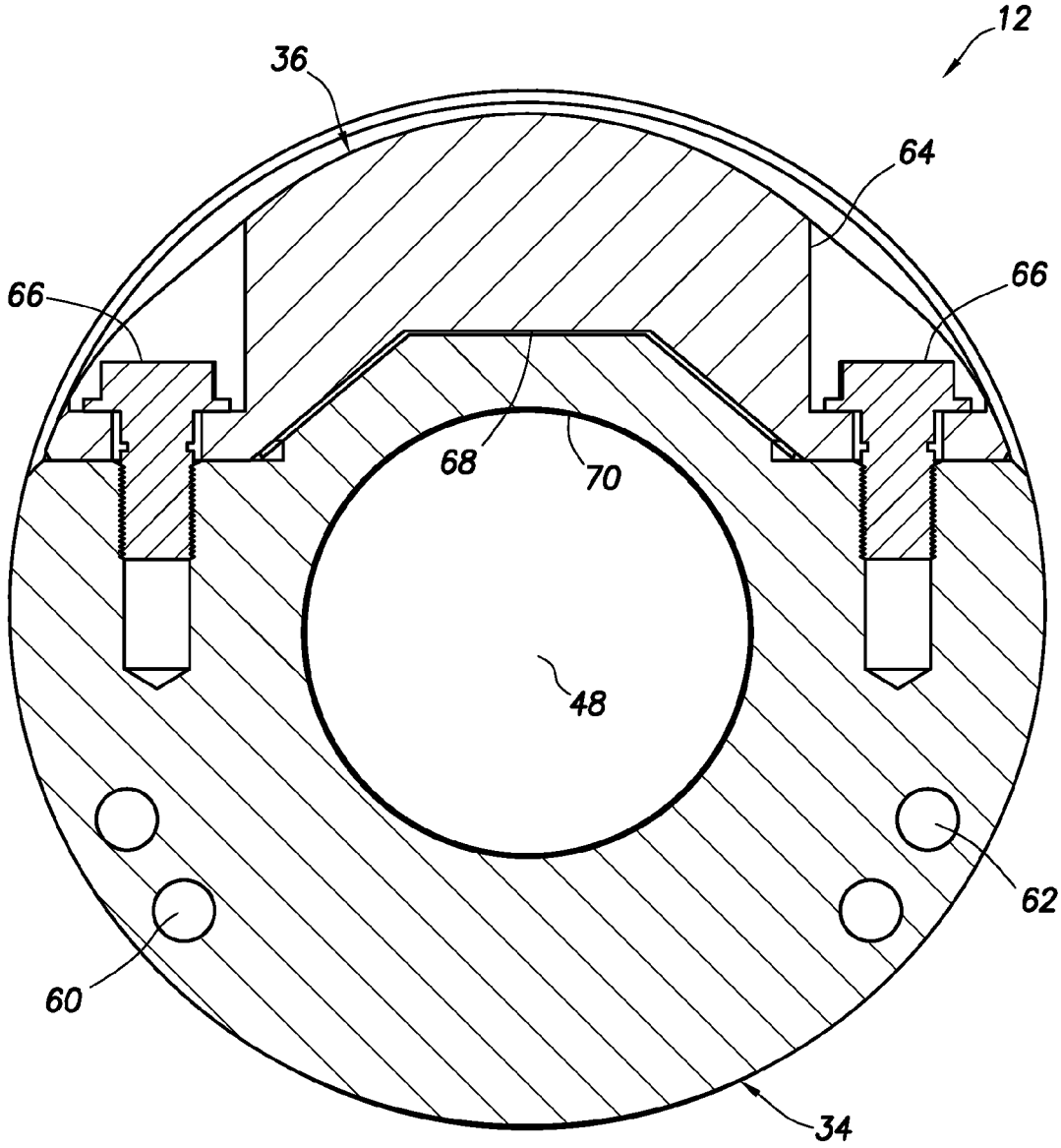
FIG. 4 is an enlarged scale cross-sectional view of the housing assembly and a manifold of the modular controller, taken along line 4-4 of FIG. 3.

Referring additionally now to FIG. 4, an enlarged scale cross-sectional view of the control system 12 is representatively illustrated. In this view, the manner in which the manifold 64 is externally attached to the housing assembly 34 is representatively illustrated.

Note that fasteners 66 are used to secure the manifold 64 externally to the housing assembly 34. The fasteners 66 are depicted in FIG. 4 as being threaded bolts, but other types of fasteners, and other types of attachments, may be used in keeping with the principles of this disclosure.

Note, also, that a concave interface surface 68 formed on the manifold 64 receives the housing assembly 34 therein, and that the manifold thus extends partially circumferentially about the passage 48. This shape of the interface between the manifold 64 and the housing assembly 34 enhances the differential pressure resisting capabilities of the manifold and housing assembly. In particular, a sidewall 70 of the housing assembly 34 has an arch shape which is advantageous for its differential pressure resisting capabilities.

The circumferential profile of the manifold 64 further allows larger fluid passageways for increased flow area, and an uninterrupted contour within the housing assembly 34, preventing the possibility of jarring the controller 36 during run-in or pulling out of the well. Furthermore, this profile allows convenient and reliable fluid communication methods between the manifold 64 and the housing assembly 34, thereby aiding controller 36 and system 12 modularity as depicted in FIG. 5 and described below.

Figure 5A:
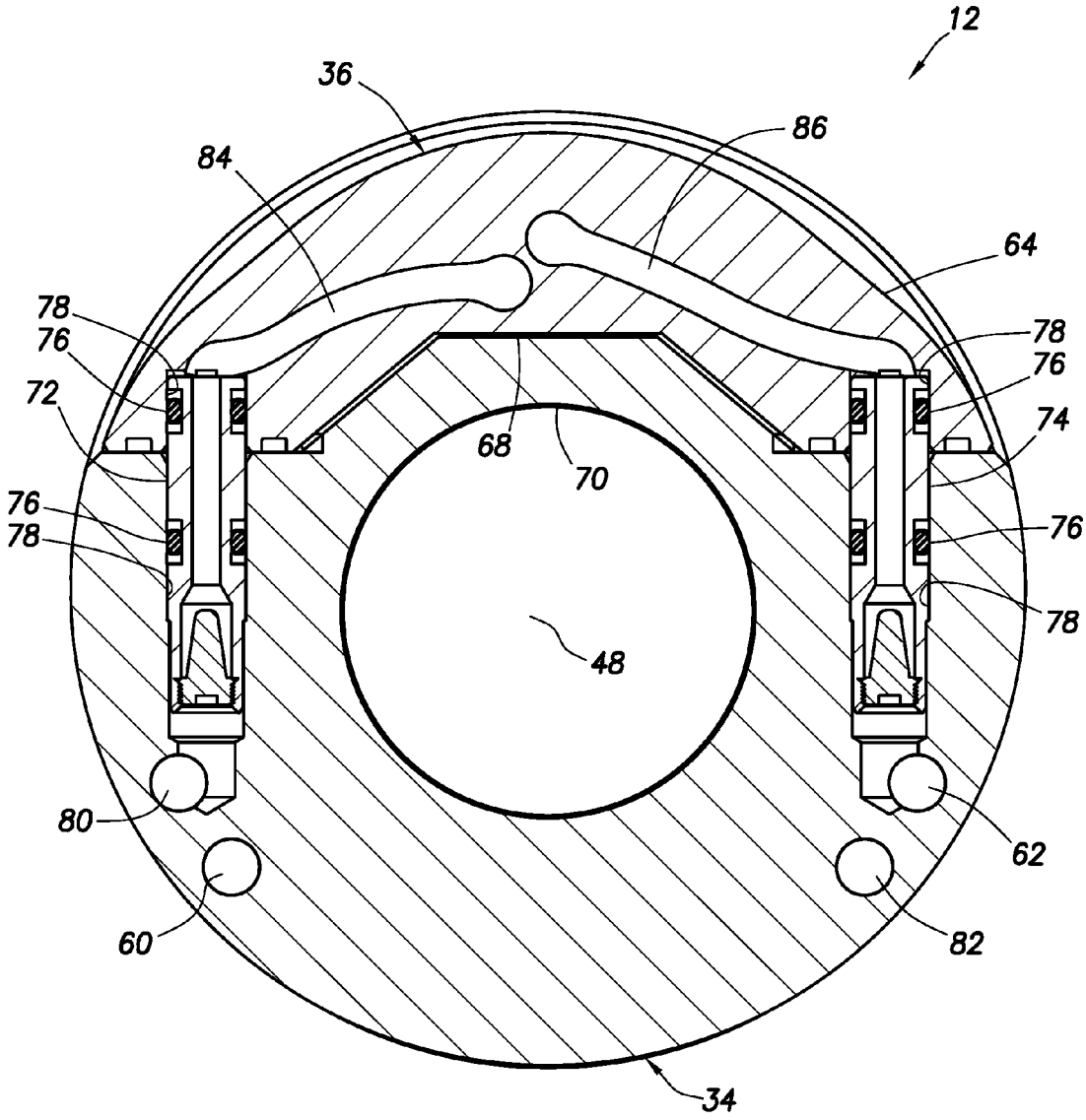
FIGS. 5A & B are further cross-sectional views of the housing assembly and manifold, taken along respective lines 5A-5A and 5B-5B of FIG. 3.
Figure 5B:
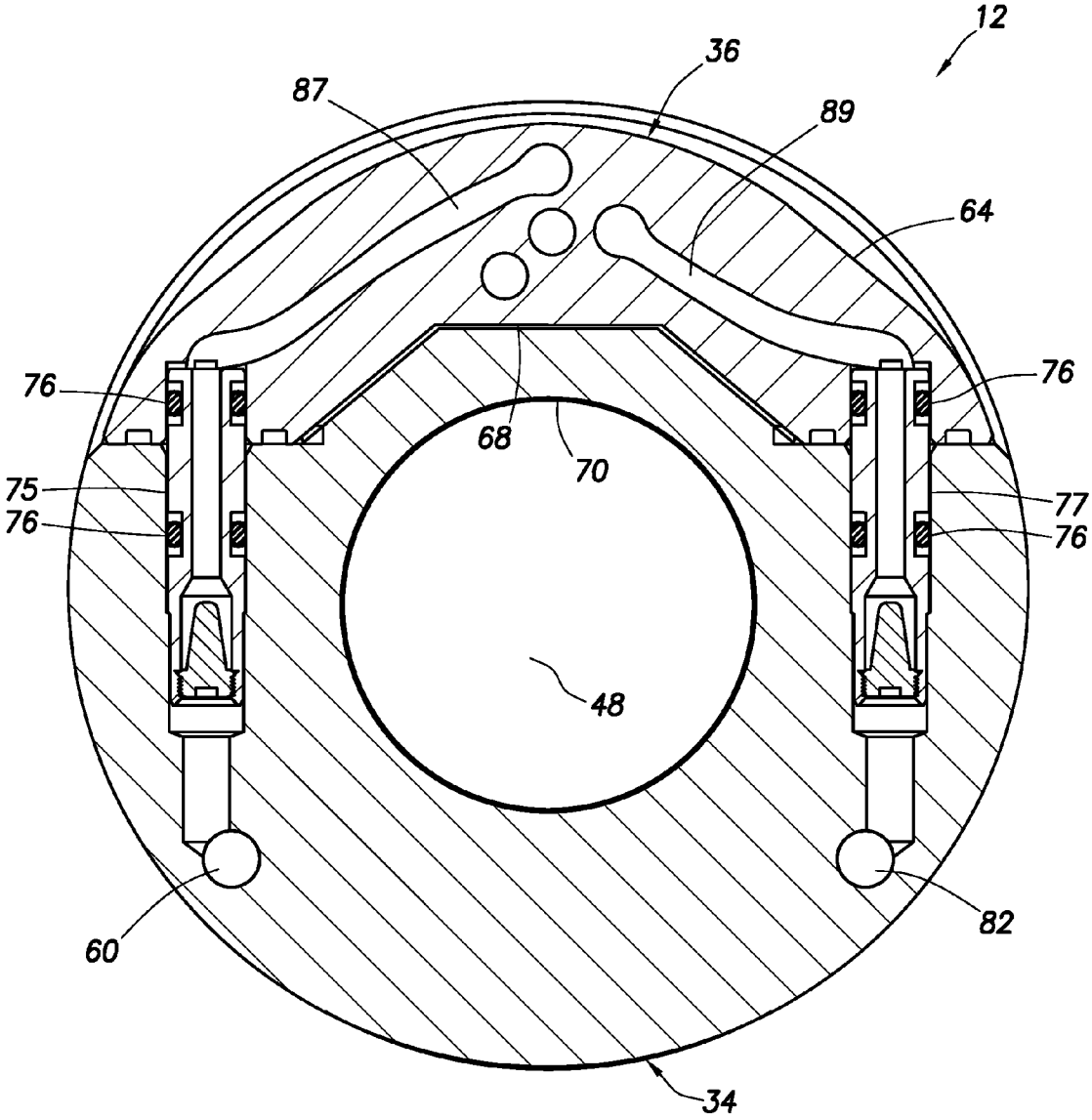

Referring now to FIG. 5, another enlarged scale cross-sectional view of the control system 12 is representatively illustrated. In this view, the manner in which sealed communication between the controller 36 and the housing assembly 34 is provided may be clearly seen.

Relatively small tubes 72, 74 having seals 76 thereon are received in seal bores 78 formed in the manifold 64 and housing assembly 34. Although only two of the tubes 72, 74 are visible in FIG. 5, this example of the control system 12 preferably includes four such tubes for providing sealed communication between each of the pressure sources 20, 22 and the actuator 18 via the control valve 14, as described more fully below.

The pressure sources 20, 22 are in communication with respective lines 80, 62 in the housing assembly 34, and the actuator 18 is in communication with additional lines 60, 82 in the housing assembly. The manifold 64 provides convenient sealed communication between the controller 36 and each of the lines 60, 62, 80, 82 in the housing assembly 34 via the tubes 72, 74, 75, 77 and passages 84, 86, 87, 89 formed in the manifold. Tubes 75, 77 and passages 87, 89 are visible in FIG. 5B.

The passages 84, 86, 87, 89 are specially constructed for routing fluid and pressure between the lines 60, 62, 80, 82 and the control valve 14 in the controller 36. Preferably, the manifold 64 is constructed with the passages 84, 86, 87, 89 therein using a progressive material deposition process, but any method may be used for constructing the manifold in keeping with the principles of this disclosure.

Note that, as depicted in FIGS. 4 & 5, the housing assembly 34 is provided with an uninterrupted interior profile which is especially advantageous for use with retrievable bi-directional running tools.

Referring additionally now to FIGS. 6A-D, longitudinal cross-sectional views of the modular controller 36 are representatively illustrated apart from the remainder of the control system 12. In these views, the manner in which the various components of the controller 36 are arranged and interconnected can be conveniently seen.

Figure 6A:
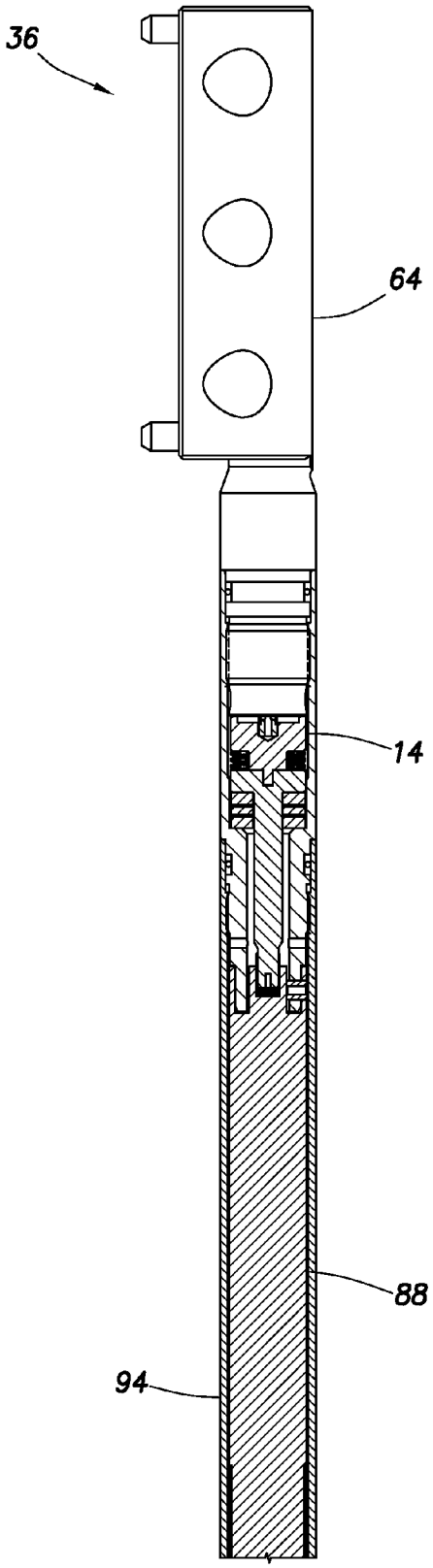
FIGS. 6A-D are cross-sectional views of successive axial sections of the modular controller.

In FIG. 6A, an upper portion of the controller 36 includes the manifold 64, the control valve 14 and a motor 88 for operating the control valve. Note that it is not necessary for the control valve 14 to be motor-operated, since any other type of control valve or valves may be used, if desired.

As described above, the manifold 64 provides sealed communication between the control valve 14 and the lines 60, 62, 80, 82 in the housing assembly 34. The control valve 14 is used to operate the actuator 18 by providing selective communication between the lines 80, 62 and the lines 60, 82 to thereby selectively connect the pressure sources 20, 22 to the chambers 24, 26 of the actuator 18.

The control valve 14 is preferably a rotary control valve of the type described in U.S. patent application Ser. No. 11/946, 332 filed on Nov. 28, 2007, the entire disclosure of which is incorporated herein by this reference. However, other types of control valves may be used for the control valve 14 in keeping with the principles of this disclosure.

Figure 6B:
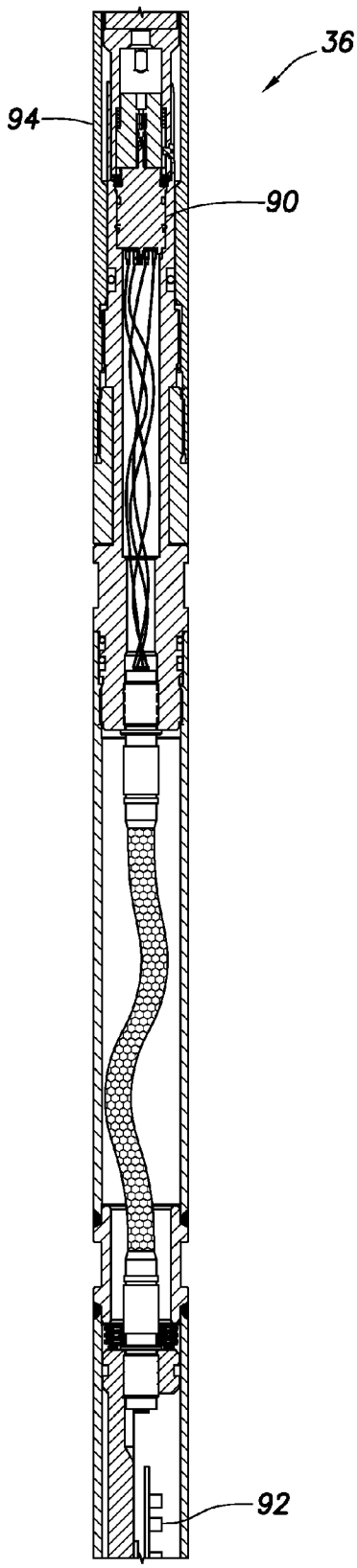

In FIG. 6B, it may be seen that a sealed bulkhead 90 is provided between the motor 88 and control electronic circuitry 92 in the modular controller 36. Preferably, the motor 88 is contained in pressurized fluid (such as dielectric fluid) within its outer housing 94, and so the bulkhead 90 isolates this fluid from the control circuitry 92.

Figure 6C:
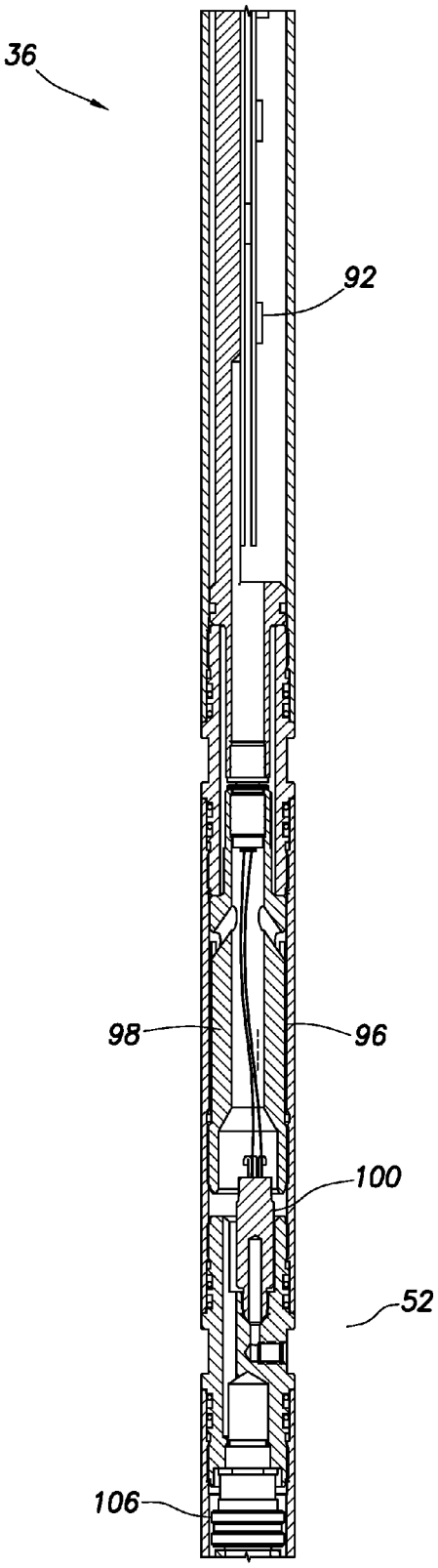
Figure 6D:
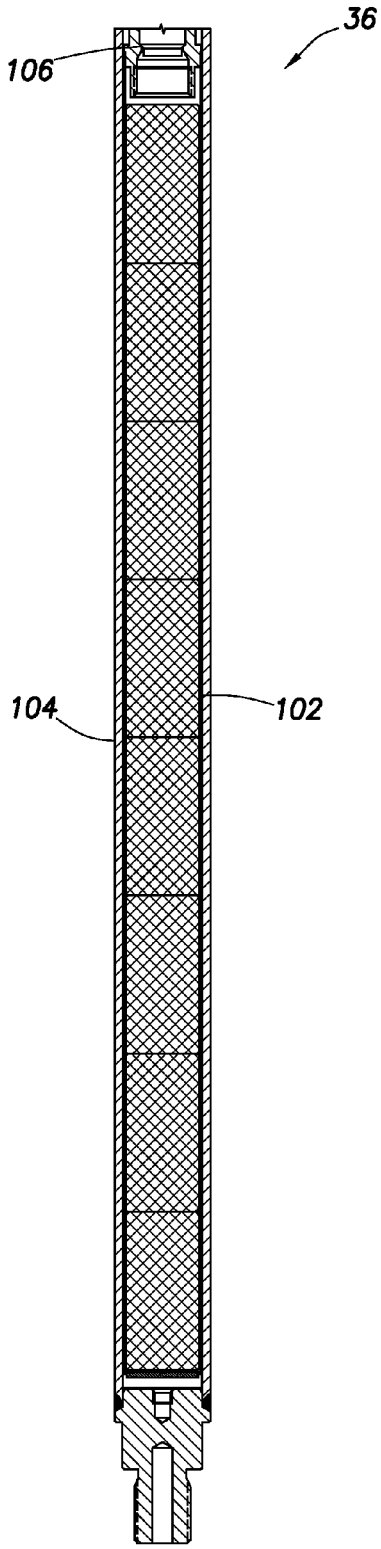

In FIG. 6C, it may be seen that the control circuitry 92 is connected to a telemetry device 96 for wireless communication with a remote location (such as the surface or another location in the well). In this example, the telemetry device 96 comprises two acoustic telemetry components, one for receiving acoustic signals from the remote location (e.g., commands to operate the control valve 14), and the other for transmitting acoustic signals to the remote location (e.g., data relating to the operation of the controller 36).

The telemetry device 96 preferably includes a relatively thin and flexible piezoelectric material applied externally to a tubular mandrel 98, but other types of acoustic telemetry devices, receivers, transmitters, etc. may be used in keeping with the principles of this disclosure. Furthermore, any type of telemetry device (such as electromagnetic, pressure pulse, etc.) may be used instead of, or in addition to, the acoustic telemetry device 96 if desired. For example, the telemetry device 96 could comprise a pressure transducer, hydrophone, antenna, etc.

A hydrophone or other type of pressure sensor 100 is also included in the controller 36, and is connected to the control circuitry 92. As depicted in FIG. 6C, the controller 36 is configured so that the pressure sensor 100 is operative to detect pressure in the annulus 52 in the well system 10. In situations in which the annulus 52 is used as a relatively high pressure source, it is useful to have an indication of the pressure in the annulus at the controller 36. In addition, or alternatively, the pressure sensor 100 can serve as a telemetry device for receiving signals transmitted from a remote location via pressure pulses and/or pressure profiles in the annulus 52.

In response to the signals received by the telemetry device 96 (and/or the pressure sensor 100 which may serve as a telemetry device), the control circuitry 92 operates the control valve 14, for example, by appropriately applying electrical power to the motor 88 from a power source 102 (see FIG. 6D), and/or otherwise operating the control valve (e.g., actuating one or more solenoid valves, spool valves, pilot valves, etc.). In this example, the power source 102 comprises multiple batteries in an outer housing 104, with a connector 106 at an upper end. Preferably, when the housing 104 is connected to the remainder of the controller 36, electrical power is thereby supplied to the control circuitry 92.

Figure 7:
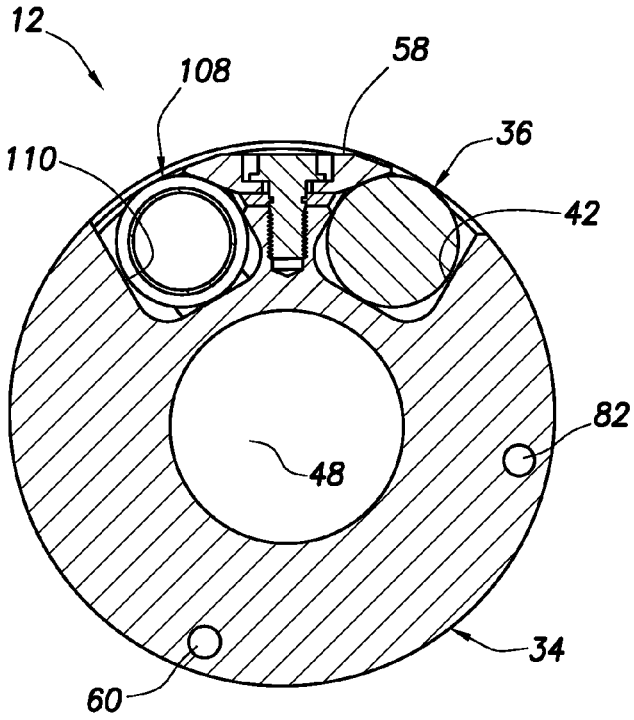
FIG. 7 is a lateral cross-sectional view of the housing assembly and modular controller.

Referring additionally now to FIG. 7, a cross-sectional view of the control system 12 is representatively illustrated. In this view, the manner in which the controller 36 is received in the recess 42, and the manner in which the retainer 58 biases the controller against a side of the recess for enhanced acoustic coupling, can be clearly seen.

Note that an additional module 108 is received in another longitudinal recess 110 formed externally on the housing assembly 34, and is retained therein by the retainer 58 which biases the module against a side of the recess. The module 108 could, for example, comprise a relatively long range telemetry device, such as an acoustic telemetry transceiver. In that case, the telemetry device 96 could be used to communicate with the module 108 over the relatively short distance between the controller 36 and the module 108, and the module could be used to communicate with a remote location over a relatively long distance.

Figure 8:
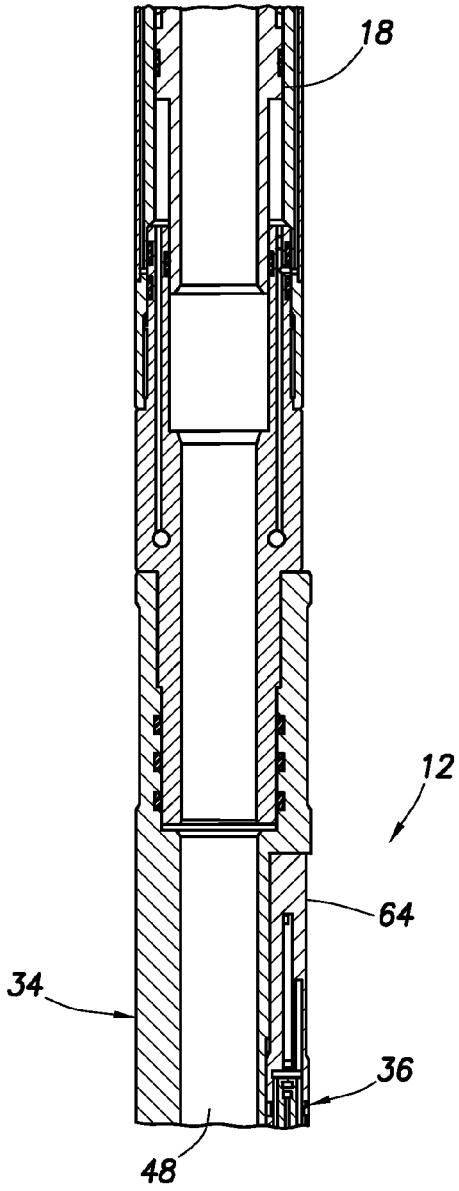
FIG. 8 is a partial longitudinal cross-sectional view of the control system as connected to an actuator in the well system of FIG. 1.

Referring additionally now to FIG. 8, a cross-sectional view of the control system 12 as connected to the actuator 18 is representatively illustrated. In this view, the manner in which the control system 12 interfaces with the actuator 18 can be more clearly seen. Although various hydraulic lines which provide fluid communication between the manifold 64 and the actuator 18 are not visible in FIG. 8, it will be appreciated that these lines do function to appropriately connect the pressure sources 20, 22 to the actuator via the manifold 64 and control valve 14 of the controller 36.

It may now be fully appreciated that the above disclosure provides many advancements to the art of controlling operation of well tools downhole. For example, the modular controller 36 is externally accessible and can be tested separately from the housing assembly 34 and other portions of the control system 12. As another example, the manifold 64 is uniquely configured to provide sealed communication between the controller 36 and the housing assembly 34, and is configured to enhance the differential pressure resisting capabilities of these elements.

The above disclosure describes an actuator control system 12 which includes a generally tubular housing assembly 34 having at least one line 60, 62, 80, 82 therein for controlling operation of an actuator 18. A modular controller 36 is attached externally to the housing assembly 34 and is interconnected to the line(s) 60, 62, 80, 82.

The housing assembly 34 may include a flow passage 48 extending generally longitudinally through the housing assembly 34. The modular controller 36 is preferably free of any component which completely encircles the flow passage 48.

The modular controller 36 may include a control valve 14 therein for controlling operation of the actuator 18 via the line(s) 60, 62, 80, 82. The modular controller 36 may also include a motor 88 and an electrical power source 102 therein for actuating the control valve 14.

The modular controller 36 can include at least one telemetry device 96, 100 for wireless communication with a remote location. The modular controller 36 may also include control circuitry 92 which controls actuation of the motor 88 to operate the control valve 14 (or otherwise operate one or more control valves) in response to commands received by the telemetry device(s) 96, 100.

The modular controller 36 may be attached to the housing assembly 34 and interconnected to the line(s) 60, 62, 80, 82 via a manifold 64 which extends partially circumferentially about the housing assembly 34.

The above disclosure also describes a method of constructing an actuator control system 12, which method includes the steps of: assembling a modular controller 36, the modular controller 36 including at least one control valve 14 therein for controlling operation of an actuator 18 via at least one hydraulic line 60, 62, 80, 82; testing the modular controller 36, including functionally testing the control valve 14; and then attaching the modular controller 36 to a housing assembly 34 having the line(s) 60, 62, 80, 82 formed therein.

The method may include the step of pressure testing the housing assembly 34, including pressure testing the line(s) 60, 62, 80, 82. The well tools 44, 46 can furthermore be function tested to verify component tool operation(s), apart from the controller 36. The modular controller 36 testing step may be performed separately from the housing assembly 34 pressure testing step.

The modular controller 36 attaching step may include connecting a manifold 64 of the modular controller 36 to the housing assembly 34, thereby providing sealed fluid communication between the control valve 14 and the actuator 18 via the manifold 64. The modular controller 36 testing step may include pressure testing the manifold 64 prior to the step of attaching the modular controller 36 to the housing assembly 34.

The modular controller 36 may also include a motor 88 and an electrical power source 102 therein for actuating the control valve 14, and the method may include the step of testing the motor 88 and electrical power source 102 prior to the step of attaching the modular controller 36 to the housing assembly 34.

The modular controller 34 may also include at least one telemetry device 96, 100 for wireless communication with a remote location, and the method may include the step of testing the telemetry device(s) 96, 100 prior to the step of attaching the modular controller 36 to the housing assembly 34.

The modular controller 36 may also include control circuitry 92 which controls actuation of the motor 88 to operate the control valve 14 in response to commands received by the telemetry device(s) 96, 100, and the method may include the step of testing the control circuitry 92 prior to the step of attaching the modular controller 36 to the housing assembly 34.

The above disclosure also describes an actuator control system 12 which includes a generally tubular housing assembly 34 having at least one line 60, 62, 80, 82 therein for controlling operation of an actuator 18; and a modular controller 36 attached separately to the housing assembly 34 and interconnected to the line(s) 60, 62, 80, 82 via a manifold 64 of the modular controller 36. The manifold 64 includes a concave interface surface 68 which receives the housing assembly 34 therein.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. An actuator control system, comprising:

a generally tubular housing assembly having at least one line therein for controlling operation of an actuator, wherein the housing assembly includes a flow passage extending generally longitudinally through the housing assembly; and a modular controller attached externally to the housing assembly and interconnected to the line, wherein the modular controller includes at least one control valve which controls operation of the actuator via the line.

2. The system of claim 1, wherein the modular controller is free of any component which completely encircles the flow passage.

3. The system of claim 1, wherein the modular controller further includes a motor and an electrical power source therein for actuating the control valve.

4. The system of claim 3, wherein the modular controller further comprises a telemetry device for wireless communication with a remote location.

5. The system of claim 4, wherein the modular controller further includes control circuitry which controls actuation of the motor to operate the control valve in response to commands received by the telemetry device.

6. The system of claim 1, wherein the modular controller is attached to the housing assembly and interconnected to the line via a manifold which extends partially circumferentially about the housing assembly.

7. An actuator control system, comprising:

a generally tubular housing assembly having at least one line therein for controlling operation of an actuator; and a modular controller attached separately to the housing assembly and interconnected to the line via a manifold of the modular controller, the manifold including a concave interface surface which receives the housing assembly therein.

8. The system of claim 7, wherein the housing assembly includes a flow passage extending generally longitudinally through the housing assembly, and wherein the modular controller is free of any component which completely encircles the flow passage.

9. The system of claim 7, wherein the modular controller includes at least one control valve therein for controlling operation of the actuator via the line.

10. The system of claim 9, wherein the modular controller further includes a motor and an electrical power source therein for actuating the control valve.

11. The system of claim 10, wherein the modular controller further comprises a telemetry device for wireless communication with a remote location.

12. The system of claim 11, wherein the modular controller further includes control circuitry which control actuation of the motor to operate the control valve in response to commands received by the telemetry device.

13. An actuator control system, comprising:

a generally tubular housing assembly having at least one line therein for controlling operation of an actuator; and a modular controller attached externally to the housing assembly and interconnected to the line, wherein the modular controller includes at least one control valve therein for controlling operation of the actuator via the line, a motor and an electrical power source therein for actuating the control valve, and a telemetry device for wireless communication with a remote location.

14. The system of claim 13, wherein the housing assembly includes a flow passage extending generally longitudinally through the housing assembly, and wherein the modular controller is free of any component which completely encircles the flow passage.

15. The system of claim 13, wherein the modular controller further includes control circuitry which controls actuation of the motor to operate the control valve in response to commands received by the telemetry device.

16. The system of claim 13, wherein the modular controller is attached to the housing assembly and interconnected to the line via a manifold which extends partially circumferentially about the housing assembly.

17. An actuator control system, comprising:

a generally tubular housing assembly having at least one line therein for controlling operation of an actuator; and a modular controller attached externally to the housing assembly and interconnected to the line, wherein the modular controller is attached to the housing assembly and interconnected to the line via a manifold which extends partially circumferentially about the housing assembly.

18. The system of claim 17, wherein the housing assembly includes a flow passage extending generally longitudinally through the housing assembly, and wherein the modular controller is free of any component which completely encircles the flow passage.

19. The system of claim 17, wherein the modular controller includes at least one control valve therein for controlling operation of the actuator via the line.

20. The system of claim 19, wherein the modular controller further includes a motor and an electrical power source therein for actuating the control valve.

21. The system of claim 20, wherein the modular controller further comprises a telemetry device for wireless communication with a remote location.

22. The system of claim 21, wherein the modular controller further includes control circuitry which controls actuation of the motor to operate the control valve in response to commands received by the telemetry device.

23. An actuator control system, comprising:

a generally tubular housing assembly having at least one line therein which controls operation of an actuator, wherein the housing assembly includes a flow passage extending generally longitudinally through the housing assembly; and a modular controller attached externally to the housing assembly and interconnected to the line, wherein the modular controller is free of any component which completely encircles the flow passage, and wherein the modular controller is attached to the housing assembly and interconnected to the line via a manifold which extends partially circumferentially about the housing assembly.

* * * * *